US006082164A

United States Patent [19]

Palmer

[11] Patent Number: 6,082,164

[45] Date of Patent: Jul. 4, 2000

[54] METHOD AND APPARATUS FOR SUPPORTING AND POSITIONING A WORKPIECE IN RELATION TO A MACHINE

[76] Inventor: Steven E. Palmer, 7850 Linda Cir., Denver, Colo. 80221

[21] Appl. No.: 09/236,263

[22] Filed: Jan. 22, 1999

Related U.S. Application Data

[60] Provisional application No. 60/072,411, Jan. 24, 1998.

[51] Int. Cl.[7] ..... B21D 11/22

[52] U.S. Cl. ..... 72/319; 72/461

[58] Field of Search ..... 72/461, 319, 320, 72/321; 269/303

[56] References Cited

U.S. PATENT DOCUMENTS

| | | | |
|---|---|---|---|
| 2,208,061 | 7/1940 | Warger | 72/321 |
| 3,726,120 | 4/1973 | Hugert | 72/319 |
| 5,501,095 | 3/1996 | Dilger | 72/461 |
| 5,761,939 | 6/1998 | Spencer | 72/319 |

*Primary Examiner*—Daniel C. Crane
*Attorney, Agent, or Firm*—Brian D. Smith, P.C.

[57] ABSTRACT

A method and apparatus for supporting and adjusting the position of a workpiece in relation to a machine are disclosed. The apparatus includes an edge guide against which an edge of the workpiece is placed; and a swinging support structure for (1) supporting the edge guide for swinging movement in a plane to adjust the edge guide's distance from the machine, and for (2) maintaining the edge guide in a generally parallel orientation relative to the machine as the edge guide is swung to and from the machine. The method includes placing the edge of the workpiece against the edge guide so that the workpiece is in the parallel orientation relative to the machine; and swinging the edge guide to adjust its distance from the machine so that the workpiece will be in a desired position relative to the machine when the workpiece's edge is against the edge guide.

20 Claims, 3 Drawing Sheets

METHOD AND APPARATUS FOR SUPPORTING AND POSITIONING A WORKPIECE IN RELATION TO A MACHINE

CROSS REFERENCE TO RELATED APPLICATIONS

This application is a nonprovisional application claiming the benefit under 35 USC 119(e) of U.S. provisional application Ser. No. 60/072,411, filed on Jan. 24, 1998.

TECHNICAL FIELD OF THE INVENTION

The present invention relates generally to devices that are suited to support and control the orientation of sheets of metal, or other workpieces, as they are positioned for bending, cutting or other work by a machine served by the device.

BACKGROUND OF THE INVENTION

The use of some machines calls for supporting a workpiece while presenting it with a particular orientation to the machine. For example, consider the use of a common bending machine, known as a sheet bending brake, to bend a rectangular workpiece of sheet metal.

In order to bend such a workpiece using a typical sheet bending brake, like the brake described in U.S. Pat. No. 4,557,132, ordinarily the workpiece is first positioned upon the brake's clamping surface so that the edges of the workpiece have a desired orientation with respect to the brake. Commonly, a rectangular workpiece is positioned so that its front and rear edges are generally parallel with the front side of the brake.

Such a position allows the typical brake to bend the workpiece along a line that is generally parallel to the workpiece's front and rear edges. It is common for the human operator of a brake to position the workpiece manually, perhaps with the assistance of a helper, controlling the workpiece's orientation as it is presented to the brake. As the operator positions the workpiece upon the brake's clamping surface, he or she visually estimates, or perhaps determines with the assistance of temporary markings placed upon the workpiece, whether the workpiece is properly oriented or aligned relative to the brake.

Clearly, it would often be advantageous to equip a brake, or other machine, with an uncomplicated device to help support the workpiece and guide it to the proper orientation quickly, accurately and with relatively little effort, as the workpiece is positioned at the machine. It would also be advantageous if such a device could adjust easily and quickly to handle workpieces of varying size, since the dimensions of the workpiece presented to a brake or other machine may change from job to job.

Furthermore, it would also be advantageous if such a device could continue to support and control the orientation of the workpiece even if the rear edge of the workpiece must be raised above its original controlled position. Such a capability would, for example, permit the operator of a brake to place the front of a workpiece in a raised position (but with a controlled orientation) upon a clamping surface located somewhat higher than the device, and then to elevate and support the rear of the workpiece (while otherwise maintaining its orientation) so that the workpiece will be reasonably level when clamping occurs.

It would also be advantageous if such a device, once it has performed its function, could be collapsed to occupy relatively little space around the machine and to avoid any interference with the machine's operation. And it would be advantageous if such a device, even when so collapsed, could remain adjacent to the machine and therefore readily available for the device's next use.

Various devices that provide workpiece support have been described. For example, U.S. Pat. No. 5,379,816 teaches an auxiliary support device, suitable for use with table-type power tools, whose disclosed embodiment includes deployable legs and certain components that may slidingly extend to desired positions.

U.S. Pat. No. 4,410,023 teaches a work holder, suitable for use with a shearing or cutting machine, whose disclosed embodiment includes a horizontal support arm slidably disposed through brackets supported by upright members. That patent also discloses a modified adjustable extension member that includes a single extension arm that is hinged to the end of the horizontal support arm and is able to swing in a horizontal plane to broaden the area of support it provides. However, the swinging extension arm is not disclosed to support an edge guide to impart a preferred, predetermined orientation to the supported workpiece in the manner of the present invention.

U.S. Pat. No. 4,512,174 teaches a combined sheet bending brake and platform. The disclosed embodiment of the platform comprises a U-shaped tubular bar whose arms are telescopically received in the brake's rear rail, in a way that permits the platform to be extended outward, into a supporting position, from a storage position within the confines of the brake. The patent also describes a stop that can be moved along a track, for adjusting a sheet in proper position for bending. However, neither the disclosed platform nor the disclosed stop appears to provide adjustable workpiece support and orientation control in the same manner as the present invention.

DISCLOSURE OF THE INVENTION

It is an object of the present invention to provide an apparatus for supporting and adjusting the position of a workpiece in relation to a machine so as to enable the machine operator to quickly and easily adjust the workpiece's position relative to the machine. It is another object of the present invention to provide such support and positioning with an apparatus that may, when not in use, collapse quickly into a configuration that takes up little space and therefore need not be removed from the machine and indeed may even be left attached to the machine.

In order to achieve the foregoing objects, the present invention provides a method and apparatus for supporting and adjusting the position of a workpiece in relation to a machine. In its broadest sense, the apparatus includes an edge guide or guide means against which the workpiece is placed and swinging support means for (1) supporting the edge guide for swinging movement in a plane to adjust the edge guide's distance from the machine, and (2) maintaining the edge guide in a predetermined angular orientation relative to the machine as the edge guide is swung.

In using the apparatus to place a workpiece in a desired position in relation to the machine, an operator of the machine simply places a predetermined edge, typically a straight edge, of the workpiece against the edge guide so that the workpiece is in the predetermined angular orientation relative to the machine. The operator may also swing the edge guide to adjust its distance from the machine so that the workpiece will be in the desired position relative to the machine when its straight edge (or other edge having a known shape) is against the edge guide. Since the swinging support means as mentioned above maintains the edge guide in the predetermined angular orientation relative to the machine as it is swung to and from the machine, it therefore also imparts to the workpiece the same, predetermined angular orientation relative to the machine as long as the predetermined edge of the workpiece is kept against the edge guide.

In addition and unlike the platform disclosed in U.S. Pat. No. 4,512,174, when stored between uses the apparatus of the present invention does not intrude substantially into the confines of the machine being served. Instead, the swinging support means of the present invention can be pivoted and rotated toward the machine until both the swinging support means and the edge guide have moved quite near the machine, providing a collapsed or stored position. In that position, the present invention takes up little space around the machine and will not hinder the machine's operation.

A preferred embodiment of the present invention has another or auxiliary edge guide or guide means, in addition to the above described edge guide or first edge guide which may be used in conjunction with or in lieu of the first edge guide. This auxiliary edge guide is used by moving it into an elevated operable position that is generally above the first edge guide, but has the same angular orientation with respect to the machine. When in the elevated operable position, the auxiliary edge guide will typically be in a position which is generally level with a working portion of the machine, thereby generally making it easier for the machine operator to place the workpiece in the desired position relative to the machine.

BRIEF DESCRIPTION OF THE DRAWINGS

The present invention may be more readily understood by reference to the accompanying drawings, in which like reference characters designate like elements throughout the drawing figures. In the drawings:

In FIG. 1*a*, the auxiliary edge guide of the embodiment shown in FIG. 1 is shown in two alternative positions: its lowered or stored position (shown in less detail in FIG. 1) is shown in FIG. 1*a* by broken lines, while its elevated, guiding and supporting position (not shown in FIG. 1) is shown in FIG. 1*a* by unbroken lines.

FIG. 5 also shows a right-side edge view of a workpiece, in the form of a rectangular sheet of thin material, being supported and controlled at the rear by the adjustable support and positioning apparatus, and being supported toward the front by the brake's horizontal clamping surface. In FIG. 5, the workpiece has not yet been clamped by the brake, and the auxiliary edge guide is, as in FIG. 1, still in its lowered or stored position.

DETAILED DESCRIPTION OF THE PREFERRED EMBODIMENT

Figure 1:
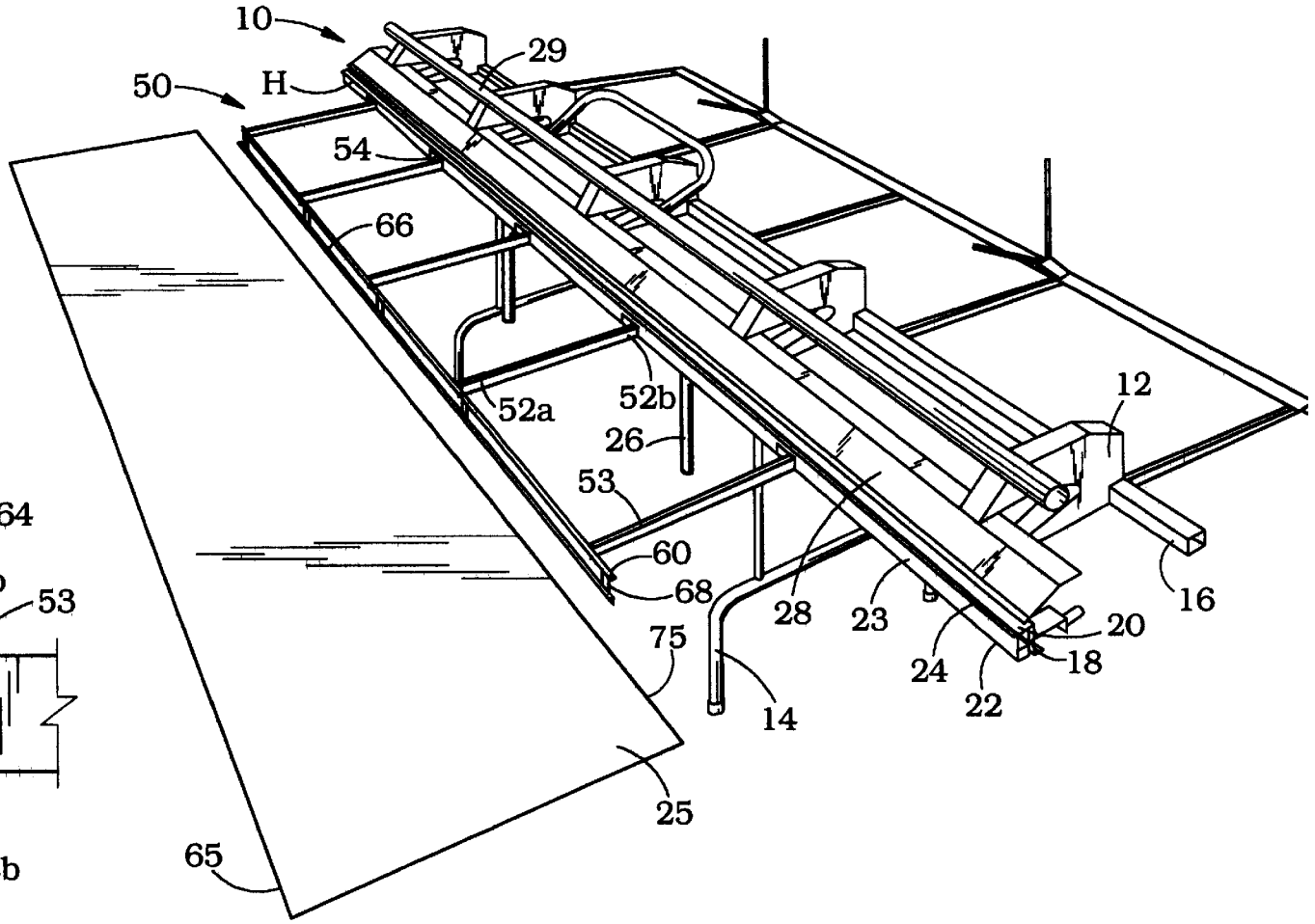
FIG. 1 is a perspective view of a preferred apparatus of the present invention for supporting and adjusting the position of a workpiece in relation to a machine such as a typical sheet bending brake, also shown. As shown, the apparatus is attached to the front side of the brake and is in its fully extended position. Also shown in FIG. 1 is a horizontal, rectangular workpiece adjacent to the apparatus.

Referring now to FIG. 1, a typical sheet bending brake 10 is illustrated as including laterally spaced C-shaped frame members 12, supporting legs 14, and base rail 16.

Brake 10 also includes a fixed member 18, extending laterally near the front of brake 10 and fixed on the front ends (obscured from view in FIG. 1) of the lower arms (not separately numbered, but best viewed in FIGS. 5 through 8) of the C-shaped frame members 12. Fixed member 18 defines, on its uppermost surface a horizontal clamping surface 20 that extends for the width of brake 10.

Brake 10 also includes a bending member 22, having a front side 23 and a sheet contacting edge 24 generally parallel to that front side 23, to provide a means for bending a workpiece 25. Workpiece 25 is a sheet of material, commonly metal or plastic. Bending member 22 extends laterally along the front of brake 10. Bending member 22 is hinged to fixed member 18 generally at H, along substantially the entire width of brake 10. As will be understood by those of ordinary skill in the art, various forms of hinge could be used, such as, for example, the form disclosed by U.S. Pat. No. 4,557,132.

Handles 26 are secured to the lower portion of bending member 22. By moving the brake's handles 26, those who operate brake 10 can rotate bending member 22 clockwise or counterclockwise (as viewed from the side in FIGS. 5 through 8).

Brake 10 also includes a clamping member 28, which is sometimes called an anvil member. Clamping member 28 extends laterally, for the width of brake 10, in an overlying relationship to the clamping surface 20. Clamping member 28, including its generally horizontal underside (not numbered), can be lowered toward or raised away from clamping surface 20 in order to clamp or unclamp, respectively, whatever workpiece 25 has been placed upon clamping surface 20.

Brake 10 includes means (partly shown and not numbered) for lowering or raising clamping member 28. As will be understood by those of ordinary skill in the art, various forms of such means could be used, such as, for example, those disclosed by U.S. Pat. No. 4,557,132. Such means include, and are activated and controlled by, the brake's clamping handle 29. Clamping handle 29 is pivotally attached to the C-shaped frame members 12, and can be rotated by the operator of brake 10 to cause clamping member 28 to be raised or lowered, as desired.

In order to bend metal, bending member 22 is rotated clockwise (as viewed from the side in FIGS. 5 through 8), by means of handles 26, from its lowest or starting position. The lowest or starting position of bending member 22, i.e., its position before any bending has occurred, is best illustrated in FIGS. 1 and 5 through 7. As bending member 22 rotates clockwise from its starting position, its sheet contacting edge 24 abuts and then presses upward against the underside of whatever workpiece 25 is supported upon clamping surface 20 of fixed member 18, causing said workpiece 25 to begin bending, as illustrated from the side in FIG. 8.

In the accompanying drawings, an apparatus 50 for supporting and adjusting the position of a workpiece 25 in relation to brake 10 (hereinafter referred to as adjustable support and positioning guide 50 or simply as guide 50), is shown attached to the front side of brake 10. Guide 50 has two primary components which are a swinging support structure or means (not numbered) and an edge guide or guide means (also not numbered). As described in detail below, the swinging support structure generally includes a plurality of equidistantly spaced swinging cross supports 52 of equal length which swing in unison. The cross supports are pivotally attached to the brake at their proximal ends by hinges 54 and pivotally attached at their distal ends to an elongate member 60. Elongate member 60 is the component that actually defines the edge guide.

Figure 2:
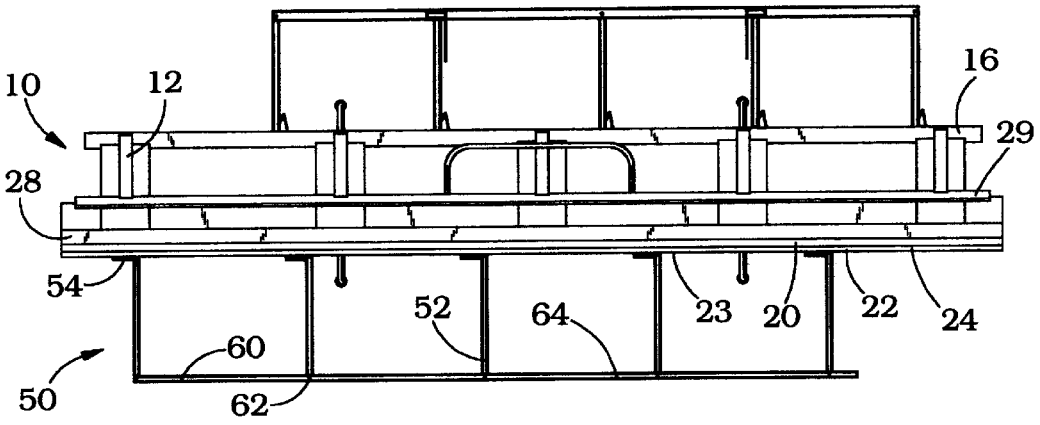
FIG. 2 is a top plan view of the adjustable support and positioning apparatus of FIG. 1, fully extended as in FIG. 1 so that its unattached, free or distal end is at its maximum distance from the front side of the typical sheet bending brake of FIG. 1, to which it is attached.
Figure 3:
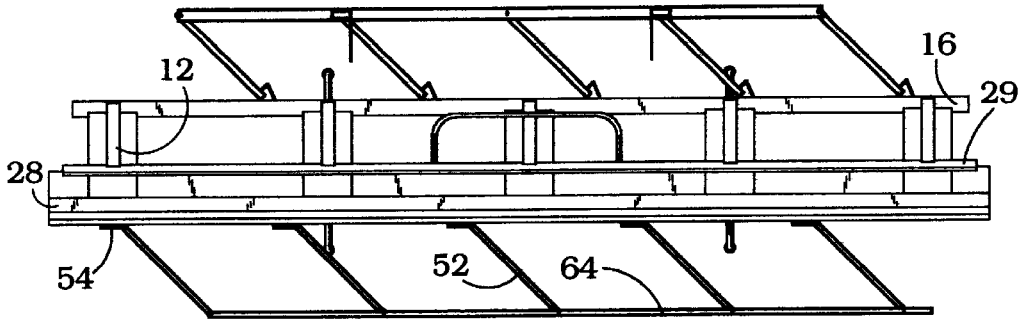
FIG. 3 is a top plan view of the adjustable support and positioning apparatus of FIG. 1, in a partially extended position in which its unattached, free or distal end is closer to the front side of the typical sheet bending brake than it was in FIG. 1.
Figure 4:
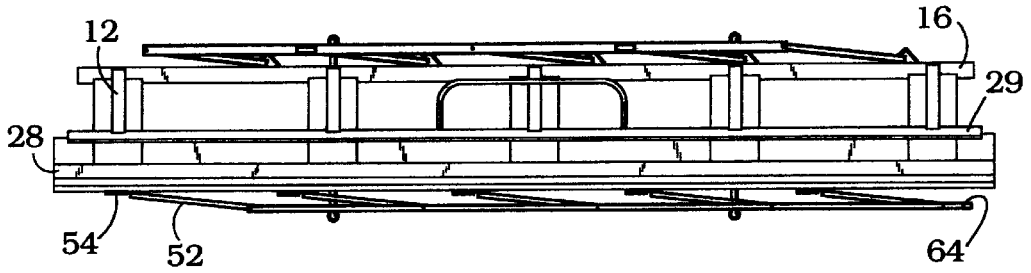
FIG. 4 is a top plan view of the adjustable support and positioning apparatus of FIG. 1, shown in a slightly extended position in which it is almost collapsed against the front of the typical sheet bending brake of FIG. 1.

As best viewed in FIGS. 2 through 4, the preferred embodiment depicted in the accompanying drawings has five swinging cross supports 52. However, it will be appreciated that the number may be varied, and that a different number may be suitable for a particular application.

Each cross support 52 is made from a separate length of metal, preferably aluminum because of its light weight, having, perpendicular to its length, a generally uniform cross section approximately in the shape of an inverted L. Therefore, each cross support 52 includes, along its entire length, a top portion 52*a* connected to a side portion 52*b*. When a cross support 52 is positioned lengthwise in a generally horizontal manner (as shown in FIGS. 1 through 7), its top portion 52*a* is likewise generally horizontal, and its side portion 52*b* is generally upright. While an L-shape is described, it will be appreciated that cross supports 52 could be provided with a different shape and cross section.

The top portion 52*a* of each cross support 52 defines a support surface 53, upon and along the top of each cross support 52. When a cross support 52 is positioned in a generally horizontal manner, its support surface 53 is likewise generally horizontal. The five cross supports 52 collectively provide a plurality of support surfaces 53 that may cooperate to support a workpiece placed upon guide 50, and that (as subsequently will be described) cooperate to support the edge guide or guide means defined by elongate member 60.

As previously mentioned, each cross support 52 is separately and pivotally supported by, and is secured at one end to, a hinge means or hinge assembly 54 attached to the brake 10. Since each of the five cross supports 52 is separately supported, guide 50 includes five separate hinge assemblies (also referred to as hinges 54 herein). In general, any plurality of cross supports 52 may be employed with an equal plurality of adjacent hinges 54.

As also shown, the five hinges 54 are equidistantly spaced from each other, and are secured to the front side 23 of (and therefore may move with) bending member 22 of brake 10, as will subsequently be described. Each of the five hinges 54 is an assembly including a metal hinge (not separately numbered), comprising a pair of metal leaves (not separately numbered) pivotally joined by a hinge pin (not separately shown). Each hinge 54 is preferably positioned so that the longitudinal axis of its hinge pin, which also serves as the axis of rotation about which a cross support 52 pivots while supported by that adjacent hinge 54, is generally vertical whenever the bending member 22 of brake 10 is in its lowest or starting position.

Each hinge is secured to the side portion 52*b* of its cross support 52 by one of its leaves at the cross support's proximal end. The other leaf of each hinge is secured to a plate (not shown) which in turn is attached to the front side 23 of bending member 22 of brake 10.

In some applications, it might be desirable instead to attach the plurality of adjacent hinges 54 to a single elongated base that extends substantially across, and is itself secured adjacent to, whatever machine is to be served by guide 50. Such an arrangement might be desirable, for example, if guide 50 needs to be repeatedly or rapidly unmounted and remounted.

Since each hinge 54 is secured to the front side 23 of bending member 22 of brake 10, each adjacent hinge 54 will move with the bending member 22 as it is rotated toward or away from its lowest or starting position. Therefore, each cross support 52, being secured at one end to a hinge 54 that pivotally supports it, will likewise move with the bending member 22 as it is so rotated.

As also shown, each cross support 52 extends away from the hinge 54 to which it is attached at an angle which is generally perpendicular to the hinge's pin. Such a generally perpendicular orientation causes the cross supports 52 to swing in a plane as they swings about their hinges. This plane, as will be appreciated, is a generally horizontal plane when bending member 22 is in its lowest or starting position, as before bending begins.

As illustrated, the cross supports 52 are of equal length and, as pivotally secured to the brake's bending member 22 by hinges 54, they are equally spaced laterally across the front of the brake 10. The cross supports 52 arc also aligned when viewed from the side (as in FIGS. 5 through 8), so that their respective support surfaces 53 are coplanar, and so that they may cooperate to provide generally level support to a workpiece 25 and to elongate member 60.

Figure 1A:
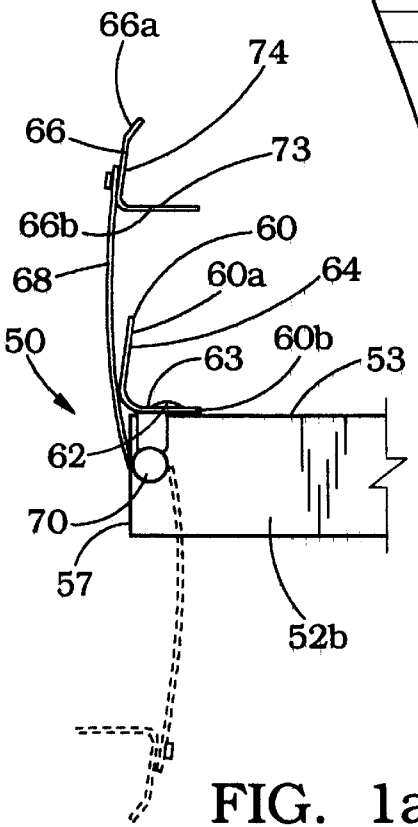
FIG. 1*a* is a fragmentary, enlarged elevation view of the right side of the free or distal end of the adjustable support and positioning apparatus of FIG. 1.

Elongate member 60 (also referred to herein as the first elongate member) is made from a length of metal, preferably galvanized steel because of its strength, having, perpendicular to its length, a generally uniform cross section approximately in the shape of an L, as best illustrated in FIG. 1*a*. Therefore, the first elongate member 60 includes, along its entire length, a guide portion 60*a* and a generally perpendicular base portion 60*b*. The generally perpendicular surfaces of base portion 60*b* and guide portion 60 facing each other respectively define a support surface 63 and a guiding surface 64 as more fully described herein. While an L-shape is shown, it will be appreciated that a different shape and cross section could be employed.

As shown, the first elongate member 60 is pivotally supported by the cross supports 52, and is pivotally secured to them by pivot members 62 which while not shown in detail are preferably loosely fitting rivets. The first elongate member 60 extends lengthwise across all of the cross supports 52, near their respective free or distal ends 57, with the underside of its base portion 60*b* pivotally supported by and upon part of their respective support surfaces 53. When the cross supports 52 are in a generally horizontal position (as when the bending member 22 of the brake 10 is in its lowest or starting position), the first elongate member's guide portion 60*a* will be generally upright and its base portion 60*b* generally horizontal, as best illustrated in FIG. 1*a*.

As shown, the base portion 60*b* of the first elongate member 60 defines a support surface 63 upon and along its top, as perhaps most clearly identified in FIG. 1*a* for supporting the workpiece when the cross supports 52 are horizontally disposed.

As also shown, the guide portion 60*a* of the first elongate member 60 defines a guiding surface 64 against and along its inward side (i.e., the side closest to or facing the brake 10), as perhaps most clearly identified in FIG. 1*a*. Surface 64 will be in an upright or generally vertical position when the cross supports 52 are horizontally disposed.

The first elongate member 60 is pivotally supported upon the cross supports 52, so that it has a predetermined angular orientation relative to the brake 10 which as shown in the drawings is generally parallel to the front side 23 of the brake's bending member 22. This generally parallel orientation is perhaps best illustrated in FIGS. 2 and 3, in which both front side 23 and guiding surface 64 are illustrated from above to appear, edge on, as parallel lines.

As shown in FIGS. 2 through 4, the first elongate member 60 is pivotally secured to all five of the cross supports 52 near their distal ends 57 by five separate pivot members 62. As will be appreciated, each pivot member 62 provides an axis of rotation (about which its cross support 52 may pivot with respect to the first elongate member 60, while remaining secured beneath it) that is generally vertical whenever the cross support 52 is generally horizontal.

While pivot members 62 are preferably loosely fitting rivets (not separately numbered) each of which passes downward through the base portion 60*b* of the first elongate member 60 and through the top portion 52*a* of each cross support 52, near the cross support's distal end 57, it will be appreciated that bolt/nut means or some other sufficiently sturdy pins could be employed, in place of the rivets, to provide the pivot members.

Turning now to FIG. 2, as shown in their fully extended positions, the five cross supports 52 are parallel to each other and remain generally parallel to one another as they are swung (as, for example, in the positions shown in FIGS. 3, 4, 6 or 7) until the guide is completely collapsed at which time they are no longer parallel but rather linearly aligned with each other. The cross supports remain parallel until collapsed due to the fact that they are all pivotally attached, as discussed above, to first elongate member 60 which provides a means of linking the cross supports 52 for rotation in unison. In addition, it will be appreciated that when the cross supports are swung about their hinges, first elongate member 60 will maintain its original, predetermined parallel orientation (relative to the brake 10) even though its distance from the brake 10 is changing. Consequently, the preferred, generally parallel orientation between the first elongate member's guiding surface 64 and the bending member's front side 23 is maintained as the first elongate member 60 is moved toward or away from the brake 10. In addition, since, as previously mentioned, cross supports 52 swing about hinges 54 in a generally horizontal plane when bending member 22 is in its lowest or starting position, elongate member 60 will also swing in the same horizontal plane (or at least a plane parallel thereto) since it is pivotally attached to the distal ends of the cross supports and generally level with the cross supports.

As mentioned, the first guide means, or first edge guide (as also used herein), includes the guide portion 60*a* of the first elongate member 60 having guiding surface 64. The guiding surface 64 provides a surface against which the workpiece's generally straight outward edge 65 (i.e., the edge farthest from the brake 10) is placed. As such, and as illustrated from the side in FIG. 5, when the workpiece's outward edge 65 is placed against surface 64, the workpiece will have the same, predetermined angular orientation as the guiding surface 64 (which as shown is parallel), relative to the front side 23 of the bending member 22.

As also shown, guiding surface 64 is preferably continuous for some substantial distance along the front (or other side, as needed) of the brake or other machine being served. The use of such a continuous surface may dependably provide continuous orientation control to a workpiece, even as the workpiece slides sideways along the edge guide (i.e., without moving toward or away from the brake or other machine being served).

It will also be appreciated that for some applications it might be useful to provide elongate member 60 with a different shape so as to provide guiding surface 64 with a different, predetermined but non-parallel orientation (as viewed from above) relative to the pivot members 62 which to the best of the inventor's knowledge should remain aligned such that a straight line drawn through them is parallel to a straight line drawn through the axes about which hinges 54 pivot. The different orientation provided by a differently shaped elongate member will be maintained as the elongate member is moved to an from the machine and is considered to be within the scope of the present invention.

In addition to its first guide means, guide 50 is also provided with a second or auxiliary guide means, including an auxiliary elongate member 66. In guide 50, the auxiliary elongate member 66 is made from a length of metal, preferably galvanized steel because of its strength, having, perpendicular to its length, a generally uniform cross section approximately in the shape of an L, as best illustrated in FIG. 1*a*. Therefore, the auxiliary elongate member 66 includes, along its entire length, a guide portion 66*a* and a base portion 66*b*. It will be appreciated that an auxiliary elongate member having a different shape and cross section could be employed in place of the one described.

As best illustrated in FIGS. 1 and 1*a*, the auxiliary elongate member 66 extends lengthwise across the front of guide 50, and is swingingly supported by five separate elongate hinge means or long hinges 68. Each of the five hinges 68 preferably includes a metal hinge (not separately numbered), comprising a pair of metal leaves (not separately numbered) pivotally joined by a hinge pin 70.

Preferably, the five hinges 68 are laterally and equidistantly spaced across the front of guide 50, and are positioned so that their respective hinge pins 70 are aligned, with the longitudinal axis of each hinge pin 70 extending horizontally along the same line. In each hinge 68, the first of the metal hinge's two leaves is secured against the guide portion 66*a* of the auxiliary elongate member 66 as best illustrated (from the side) in FIG. 1*a*. The second of the metal hinge's leaves is secured to the underside of the base portion 60*b* of the first elongate member 60, with the hinge pin 70 generally beneath that base portion 60*b*.

Figure 5:
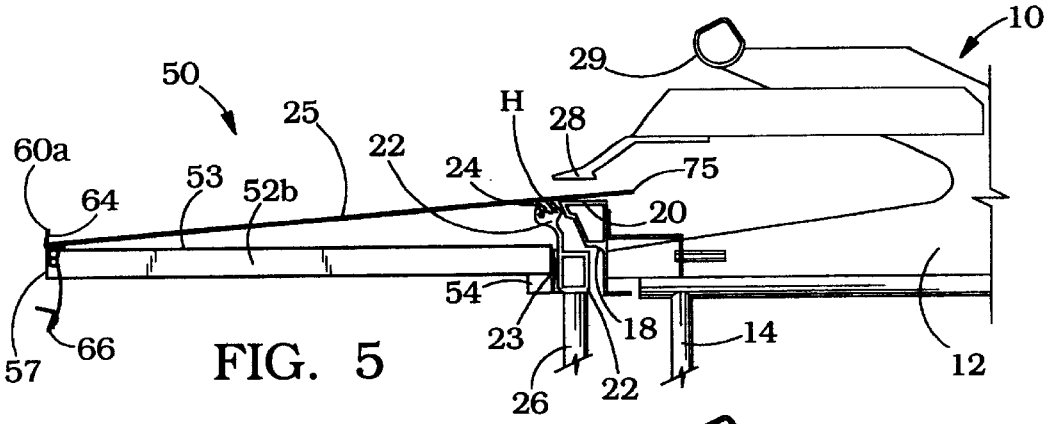
FIG. 5 is an enlarged elevation view of the right side of the adjustable support and positioning apparatus of FIG. 1, and an enlarged, fragmentary elevation view of the right side of the typical bending brake of FIG. 1.
Figure 6:
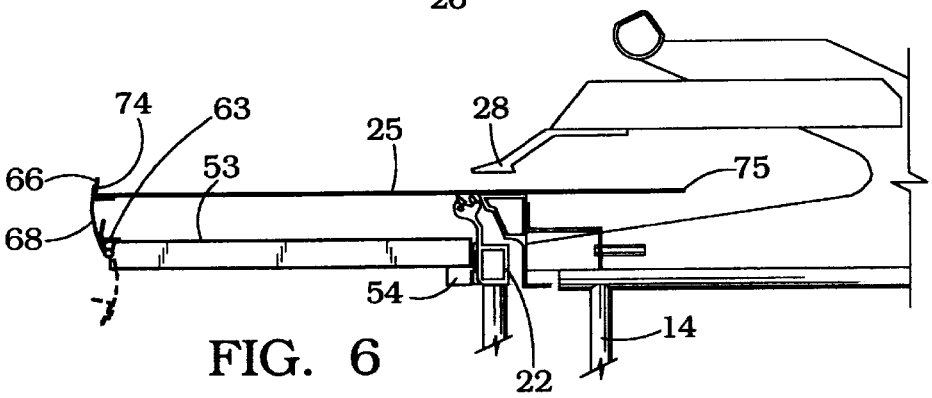
FIG. 6 is similar to FIG. 5, except that the auxiliary edge guide has been elevated and is being used to support and position the workpiece, which is horizontal and ready to be clamped.
Figure 7:
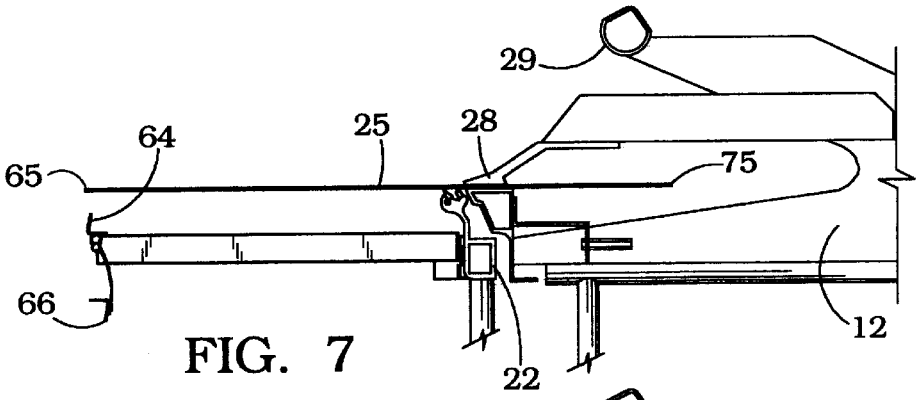
FIG. 7 is similar to FIG. 6, except that the horizontal workpiece has been clamped, and the auxiliary edge guide has been returned to its lowered or stored position.

As each hinge 68 is positioned, the longitudinal axis of its hinge pin 70 may serve as an axis of rotation about which the auxiliary elongate member 66 may be swung, between its lowered, stored position, generally below the first elongate member 60, to its elevated, guiding and supporting position, generally above the first elongate member 60. In FIGS. 1*a* and 6, the auxiliary elongate member 66 is in its elevated position, and its lowered position is shown with broken lines. In FIGS. 1, 5, 7 and 8, the auxiliary elongate member 66 is in its lowered position.

When the cross supports 52 are positioned in a generally horizontal manner, with auxiliary elongate member 66 in its elevated, guiding and supporting position, the auxiliary elongate member's guide portion 66*a* is generally upright and its base portion 66*b* is generally horizontal, as best illustrated in FIG. 1*a*. Under such circumstances, its base portion 66*b* defines a generally horizontal support surface 73 upon and along its top, which may help to support a workpiece placed, at least in part, upon base portion 66*b*. In each hinge 68, the first of the metal hinge's leaves is provided with a length so as to position the base portion 66*b* at generally the same height as the brake's clamping surface 20 whenever the auxiliary elongate member 66 is at its elevated, guiding and supporting position with the cross supports 52 in a generally horizontal position (as when the bending member 22 is at its starting position).

Furthermore, when the auxiliary elongate member 66 in its elevated, guiding and supporting position, its guide portion 66*a* defines a guiding surface 74 against and along its inward side (i.e., the side facing the brake 10), as perhaps most clearly identified in FIG. 1*a*. When, in addition, the cross supports 52 are positioned in a generally horizontal manner (as when bending member 22 is in its lowest or starting position), the guiding surface 74 is upright or generally vertical.

The auxiliary elongate member 66 is shaped, and is swingingly secured to the first elongate member 60 by the hinges 68, so that whenever it is in its elevated, guiding and supporting position, its guiding surface 74 has, relative to the brake 10, generally the same preferred, predetermined angular orientation (as viewed from above) as the first elongate member's guiding surface 64. Thus, when the auxiliary elongate member 66 is in its elevated position its guiding surface 74 will be generally parallel to the front side 23 of the brake's bending member 22.

As previously noted, the first elongate member 60 generally retains its original, predetermined angular orientation (relative to the brake 10) even as its distance from the brake 10 is adjusted. Therefore, since the auxiliary elongate member 66 is swingingly secured to the first elongate member 60 so as to remain generally parallel to it, the auxiliary elongate member 66, in its elevated position, will likewise retain its angular orientation (relative to the brake 10), even as its distance to the brake 10 is adjusted. Consequently, in guide 50 the preferred, generally parallel orientation between the auxiliary elongate member's guiding surface 74 (when the auxiliary elongate member 66 is in its elevated, guiding and supporting position) and the bending member's front side 23 is maintained even as the auxiliary elongate member 66, with its guiding surface 74, is moved.

The second or auxiliary workpiece guide means, or auxiliary edge guide, includes the guide portion 66*a* of the auxiliary elongate member 66, having guiding surface 74. The guiding surface 74 is the surface against which the outward edge 65 of workpiece 25 is placed with the workpiece 25 resting, in part, upon the auxiliary elongate member's support surface 73.

When the workpiece's outward edge 65 is placed so as to abut against the guiding surface 74, as illustrated from the side in FIG. 6, the workpiece's outward edge 65 is thereby provided with generally the same, predetermined angular orientation (as viewed from above) as the guiding surface 74, relative to the bending member's front side 23. In other words, the workpiece's generally straight outward edge 65 is made generally parallel (as viewed from above) to the bending member's front side 23.

As illustrated in FIGS. 5 through 8, guide 50 may be used to support and control the orientation of a workpiece 25 being presented to a machine, such as brake 10. When guide 50 is used with brake 10, the workpiece's inward edge 75 is placed within the brake 10, somewhat beyond the bending member's sheet contacting edge 24, as in FIG. 5. Ordinarily, this may be done manually, by the brake's operator.

So that the workpiece 25 may be placed upon and supported by guide 50, the cross supports 52 are swung to a fully or partially extended position, as the brake's operator may select to accommodate the size of the workpiece 25. Ordinarily, the brake's operator may swing the cross supports 52 away from their collapsed or stored position, to a fully or partially extended position, simply by pulling the first elongate member 60 outward, away from brake 10.

Furthermore, when the workpiece 25 is first placed upon guide 50, ordinarily the cross supports 52 are generally horizontal, the brake's bending member 22 is in its lowest or starting position, and the brake's clamping member 28 is raised above its clamping surface 20. When first placed upon guide 50, the workpiece 25 may be placed and supported, temporarily, upon whatever part of the support surfaces 53 or 63 is initially most convenient. However, in order to use guide 50 to begin controlling the orientation of the workpiece 25 for bending by brake 10, the workpiece 25 is ordinarily placed in a controlled abutting position as hereinafter described against the edge guide. If the workpiece is not initially placed in such a controlled abutting position, the workpiece's position should first be adjusted by the brake's operator to attain such a controlled abutting position.

The workpiece 25 is placed in such a controlled abutting position when its outward edge 65 abuts against the guiding surface 64, with the workpiece 25 resting in part upon the first elongate member's support surface 63, and in part within the brake 10, between the brake's clamping surface 20 and clamping member 28. In FIG. 5, the workpiece 25 is shown in such a controlled abutting position, with the cross supports 52 in the fully extended position. However, a controlled abutting position may also be attained with the cross supports 52 in a partially extended position.

To attain such a controlled abutting position, the position of the workpiece's outward edge 65 must be adjusted to abut against the first elongate member's guiding surface 64 to guide and control the workpiece's orientation. By abutting the workpiece's outward edge 65 against the guiding surface 64, as the workpiece 25 rests, in part, upon the support surface 63, the workpiece 25 is guided to a preferred, generally parallel orientation (as viewed from above) relative to the front side 23 of the brake's bending member 22.

If the workpiece 25 does not abut the guiding surface 64 when first placed upon guide 50, its outward edge 65 may be abutted against the guiding surface 64 by sliding or otherwise moving the workpiece 25 toward the guiding surface 64 until such an abutment occurs. Alternatively, the workpiece's outward edge 65 may be abutted against the guiding surface 64 by moving the first elongate member 60, with its guiding surface 64, toward the workpiece's outward edge 65 until such an abutment occurs.

When the workpiece 25 is placed in the abutting position against the edge guide, the workpiece 25 may still need to be moved inward toward or outward away from the brake 10, so that the brake 10 may bend the workpiece 25 at the location desired. If such inward or outward movement is needed, the brake's operator may move the first elongate member 60 to guide the workpiece 25 to a new controlled abutting position that is suitably inward or outward. If during such movement, the workpiece's position shifts causing the outward edge 65 to move away from the guiding surface 64, perhaps because the first elongate member 60 has been moved too abruptly, the brake's operator may simply reposition the workpiece so that its outward edge 65 is again against the guiding surface 64.

In addition, to properly position the workpiece 25 inwardly or outwardly with respect to the brake 10, the operator may draw or otherwise place one or more temporary lines or markers on the workpiece's upper surface, at or near one or both of its side edges, to help indicate where the workpiece 25 should be positioned when moving it into the brake 10. Then, when using guide 50 to properly position and orient the workpiece 25, the operator may use those temporary lines or markers as a reference, as, e.g., by comparing their position to the location of the front edge (not separately numbered) of the brake's clamping surface 20, in order to place the workpiece 25 in its proper position.

In conjunction with some machines and mountings, the position provided to the workpiece 25 simply by use of the first elongate member 60 might be sufficiently level to commence working upon the workpiece 25 as soon as the workpiece 25 has been inwardly positioned and properly oriented using the first elongate member 60. If so, the last controlled abutting position provided to the workpiece 25 by use of the first elongate member 60 could serve as the workpiece's final position prior to commencing work with the machine.

However, when guide 50 is used in conjunction with the typical brake 10, the guide's auxiliary elongate member 66, with its support surface 73 and guiding surface 74, is preferably used to orient and support the workpiece 25 at its final position prior to bending. Ordinarily, the brake's operator swings the auxiliary elongate member 66 to its elevated, guiding and supporting position, as in FIG. 1*a*, preferably without moving the first elongate member 60, once the workpiece 25 has been placed at its last controlled abutting position using the first elongate member 60.

As or after the auxiliary elongate member 66 is swung to its elevated guiding and supporting position, the workpiece's outward edge 65 is raised, ordinarily by the operator, perhaps with the assistance of a helper. Then, with the auxiliary elongate member 66 in its elevated, guiding and supporting position, the workpiece 25 is placed in an elevated and controlled abutting position as hereinafter described.

With respect to guide 50, the workpiece 25 is in such an elevated and controlled abutting position when its outward edge 65 abuts against the guiding surface 74, as the workpiece 25 rests in part upon the auxiliary elongate member's support surface 73 (with the auxiliary elongate member 66 in its elevated, guiding and supporting position), and in part within the brake 10, between the brake's clamping, surface 20 and clamping member 28. In FIG. 6, the workpiece 25 is shown in such an elevated and controlled abutting position, with the cross supports 52 in a partially extended position. However, an elevated and controlled abutting position may also be attained with the cross supports 52 in a fully extended position.

To attain such an elevated and controlled abutting position, the position of the workpiece's outward edge 65 is raised and then adjusted to abut against the elevated auxiliary elongate member's guiding surface 74 to guide and control the workpiece's orientation. By abutting the workpiece's outward edge 65 against the guiding surface 74, as the workpiece 25 rests, in part, upon the elevated support surface 73, the workpiece 25 is guided to a preferred, generally parallel orientation (as viewed from above) relative to the front side 23 of the brake's bending member 22.

Furthermore, by placing the workpiece 25 in such an elevated and controlled abutting position, supported in part upon the auxiliary elongate member 66 in its elevated position, the workpiece 25 is positioned in a reasonably level manner. Such a reasonably level position, as compared to the workpiece's earlier, somewhat inclined position (as in FIG. 5) when supported in part upon the first elongate member 60, may better facilitate clamping the workpiece 25 upon the brake's clamping surface 20.

Preferably, the workpiece 25 will already have been suitably guided inward or outward, if necessary, with the help of the first elongate member 60, before the workpiece's outward edge 65 is raised and abutted against the elevated auxiliary elongate member's guiding surface 74. Therefore, the workpiece's position may need relatively little or no further inward or outward adjustment, prior to bending, once the workpiece's outward edge 65 has been abutted against that elevated guiding surface 74.

Nevertheless, if the workpiece 25 still needs to be moved inwardly or outwardly, after the workpiece 25 has been placed in an elevated and controlled abutting position, in order to place it in its final position for bending, then the elevated auxiliary elongate member 66 may be used to guide the workpiece 25 to a new elevated and controlled abutting position that is suitably inward or outward from the previous position.

Such an inward or outward adjustment in the workpiece's position may be made by moving the first elongate member 60 or the auxiliary elongate member 66. However, since the auxiliary elongate member 66 will be elevated on hinges 68, moving it under such conditions may require some additional care to prevent the hinges 68 from swinging downward, and to prevent the workpiece 25 from slipping off the auxiliary elongate member 66. For this reason, it is preferable to make most inward or outward adjustments of the workpiece's position, especially any major adjustments, before the workpiece 25 is positioned in part upon the elevated auxiliary elongate member 66.

In any event, when the workpiece 25 is placed in its final position on the clamping surface 20 prior to bending, the brake's operator may then lower the brake's clamping member 28, by means of clamping handle 29, until the workpiece 25 is firmly clamped between clamping surface 20 and clamping member 28. At this point, the auxiliary elongate member 66 may be swung downwardly, by the brake's operator, to reach its lowered or stored position, as in FIG. 7.

Figure 8:
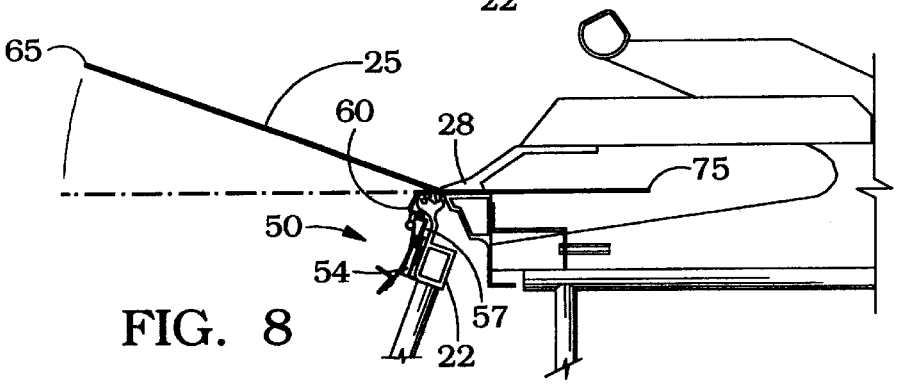
FIG. 8 is similar to FIG. 7, except that the adjustable support and positioning apparatus has collapsed against the front side of the brake's bending member, which has rotated clockwise (as viewed in FIG. 8) to bend the workpiece.

As viewed in FIG. 8, the brake's operator may then swing guide 50 inward toward the brake 10, to reach its collapsed or stored position, and may begin the bending of workpiece 25 by rotating the brake's bending member 22 clockwise (as viewed in FIG. 8), so as to press the bending member 22 upward against the underside of the clamped workpiece 25. In the alternative, the brake's operator may simply allow gravity to swing guide 50 inward, to reach its collapsed or stored position, as the bending member 22 (and, therefore, guide 50, which is secured to it) are rotated clockwise, and therefore upward, during bending.

Once the workpiece 25 is bent as desired, the brake's operator may raise the brake's clamping member 28, remove the workpiece 25, return the brake's bending member 22 to its lowest or starting position, and then swing guide 50 outward, to a fully or partially extended position, thereby preparing guide 50 to guide and support the next workpiece.

The cross supports 52, when at rest in a fully or partially extended position, provide support to a workpiece 25 placed, at least in part, upon any of the support surfaces 53, 63 or 73 (provided, of course, that a workpiece 25 may not be supported upon support surface 73 unless the auxiliary elongate member 66 is in its elevated, guiding and supporting position). Furthermore, the cross supports 52 continue to support workpiece 25 even as they are swung, since as they are swung they continue supporting the first elongate member 60, as well as the auxiliary elongate member 66 (via the five hinges 68 secured to the first elongate member 60), and the support surfaces that elongate members 60 and 66 provide.

It should be noted that as the first elongate member 60 (along with the auxiliary elongate member 66) is moved to and from brake 10, the cross supports 52 swing about their hinges 54 but remain parallel to each other 54, as illustrated from above in FIGS. 2 through 4. If the workpiece 25 is supported and at rest upon guide 50 as such swinging occurs, the workpiece 25 will tend to shift laterally, to the left or right, as the workpiece 25 and the first elongate member 60 (along with the auxiliary elongate member 66) are swung closer to or farther from the brake 10.

To the extent such a lateral movement of the workpiece 25 places it too far to the left or right (as viewed in FIGS. 2 through 4) for bending, then after the swinging is halted the brake's operator can correct the situation simply by sliding the workpiece 25 laterally back to its desired lateral location, while holding the first elongate member 60 and the auxiliary elongate member 66 generally stationary.

In order to maintain the workpiece 25 in its preferred orientation during such lateral sliding, the brake's operator may simply slide the workpiece 25 laterally with its outward edge 65 continuously abutting against whichever guiding surface, 64 or 74, is then being used to control the workpiece's orientation. Or, if the workpiece's outward edge 65 moves away from such abutment at any time during such lateral sliding, the brake's operator may restore the workpiece 25 to its preferred orientation simply by moving the outward edge 65 back into abutment against that guiding surface 64 or 74.

Furthermore, although the first elongate member 60 (along with the auxiliary elongate member 66) may be adjusted inwardly or outwardly relative to the brake 10, the first elongate member 60 may move no farther from the brake 10 than the cross supports 52 will permit in their fully extended position (illustrated in FIGS. 1, 2 and 5), and may move no closer to the brake 10 once guide 50 has reached its collapsed or stored position (approached in FIG. 4 and illustrated from the side in FIG. 8). In the guide's collapsed or stored position, the free or distal ends 57 of the cross supports 52 are in their closest position to the brake 10. In such position, the first elongate member 60, the auxiliary elongate member 66, and the five cross supports 52 are preferably generally parallel to the front side 23 of the bending member 22.

To facilitate such positioning against brake 10, the adjacent hinges 54 are preferably laterally spaced from one another, along the bending member's front side 23, by a distance somewhat greater than the length of a cross support 52. Such spacing, enables the cross supports 52 to fit between neighboring adjacent hinges 54 when swung to their collapsed or stored position against the bending member's front side 23.

Guide 50 is particularly well suited to serve a sheet bending brake, like brake 10, because guide 50 does not require legs to support it, and it can be secured to the brake without hindering the brake's operation. However, it should be noted that guide 50 could also be used to serve machines other than brakes. For example, it could be used to help support and control the orientation of a workpiece being presented to a machine that will cut, rather than bend, the workpiece. An apparatus 80 similar to guide 50 is also shown in the drawings which is attached to the back of the machine. This apparatus is not used to guide in relation to the machine but it is collapsible against the machine like guide 50 and additionally includes support members 82 and 84 as shown for supporting sheet metal having been bent or formed by the machine.

Furthermore, although guide 50 is shown, in the drawings, to be secured on the front of brake 10, in some applications guide 50 could instead be secured to a table, or other independent support, placed adjacent to the machine being served. Such an alternate mounting would be more feasible when the machine being served, unlike brake 10, does not have moving parts along its front that could be hindered by the adjacent placement of a table or other auxiliary support.

The invention has been described in detail with reference to a particular preferred embodiment thereof but it will be understood that various modifications can be effected within the spirit and scope of the invention.

What is claimed is:

1. An apparatus for supporting and adjusting the position of a workpiece in relation to a machine, said apparatus comprising:

a first edge guide against which the workpiece is placed; and swinging support means for (1) supporting said first edge guide for swinging movement in a plane to adjust said first edge guide's distance from the machine so that the position of the workpiece in relation to the machine can be adjusted, and (2) maintaining said first edge guide in a first predetermined angular orientation relative to the machine as said first edge guide is swung.

2. An apparatus as claimed in claim 1, wherein said swinging support means comprises a plurality of elongate swinging cross supports of equal length, said cross supports having a proximal end pivotally attached to said machine and a distal end pivotally attached to said first edge guide.

3. An apparatus as claimed in claim 2, wherein the first predetermined angular orientation for said first edge guide is parallel relative to the surface of the machine to which it is attached.

4. An apparatus as claimed in claim 2, further comprising a second edge guide against which the workpiece is placed, and further comprising means for (1) supporting said second edge guide in an elevated position with respect to said first edge guide; (2) moving said second edge guide to and from its elevated position; and (3) maintaining said second edge guide, when in its elevated position, in a second predetermined angular orientation relative to the machine.

5. An apparatus as claimed in claim 4, wherein the second predetermined angular orientation for said second edge guide is the same as the first predetermined angular orientation for said first edge guide.

6. An apparatus as claimed in claim 4, wherein the second predetermined angular orientation for said second edge guide is parallel to the surface of the machine to which it is attached.

7. An apparatus, for use in conjunction with a machine, to support and adjust the positioning of a workpiece in relation to the machine, said apparatus comprising:

first guide means for positioning the workpiece in a first predetermined angular orientation relative to the machine;

swinging support means for (1) supporting said first guide means (2) being swung to adjust the first guide means' distance from the machine, and (3) maintaining said first guide means in the first predetermined angular orientation relative to the machine, said swinging support means including means for pivotal attachment to said first guide means and means for pivotal attachment to said machine.

8. An apparatus as claimed in claim 7, wherein said swinging support means comprises a plurality of swinging cross supports, each of which has a proximal end and a distal end, and wherein said means for pivotal attachment to said first guide means includes a pivot member for pivotally attaching said distal end of each swinging cross support to said first guide means.

9. An apparatus as claimed in claim 8, wherein said means for pivotal attachment to said machine includes a hinge for pivotally attaching said proximal end of each swinging cross support to said machine.

10. An apparatus as claimed in claim 9, wherein the machine used in conjunction with said apparatus is a sheet bending brake, and wherein said plurality of hinges are secured to the bending member of said sheet bending brake.

11. An apparatus as claimed in claim 8, wherein said first guide means includes a first elongate member which is pivotally attached to said distal end of each swinging cross support by a said pivot member, and wherein said elongate member defines a guiding surface against which an edge of the workpiece is placed.

12. An apparatus as claimed in claim 11, wherein said elongate member is an L-shaped member defining generally perpendicular surfaces, one of which defines said guiding surface and the other of which defines a support surface for supporting the workpiece.

13. An apparatus as claimed in claim 8, further comprising second guide means for supporting and positioning the workpiece; and further comprising means for (1) supporting said second guide means in an elevated position with respect to said first guide means; (2) moving said second guide means to and from its elevated position; and (3) maintaining said second guide means, when in its elevated position, in a second predetermined angular orientation relative to the machine.

14. An apparatus as claimed in claim 13, wherein the second predetermined angular orientation for said second guide means is the same as the first predetermined angular orientation for said first guide means.

15. An apparatus as claimed in claim 13, wherein said second guide means includes a second elongate member which is pivotally attached to said first guide means, and wherein said elongate member defines a guiding surface against which the workpiece is placed.

16. An apparatus as claimed in claim 7 wherein the swinging support means enables the first guide means to be swung to a collapsed position in which the guide means is positioned against the machine.

17. A method for positioning a sheet of material having a generally straight edge in relation to a sheet bending brake so that the sheet can be bent as desired, said method comprising:

providing an apparatus comprising (1) an edge guide against which the straight edge of the sheet may be abutted, and (2) swinging support means for supporting the edge guide for swinging movement in a plane to adjust the edge guide's distance from the sheet bending brake, and maintaining the edge guide in a predetermined angular orientation relative to the machine as the edge guide is swung;

abutting the straight edge of the sheet against the edge guide; and swinging the edge guide to adjust its distance from the brake so that the sheet, when its straight edge is abutted against the edge guide, is in the desired position for bending by the brake.

18. A method as claimed in claim 17, wherein the predetermined angular orientation of the edge guide is parallel to the sheet bending brake.

19. A method for supporting and positioning a workpiece in relation to a machine, said method comprising the steps of:

providing a machine;

providing a workpiece having an edge of known shape;

providing an apparatus including:

an edge guide against which the edge of the workpiece may be placed; and swinging support means for (1) supporting the workpiece and the edge guide for swinging movement in a plane to adjust the edge guide's distance from the machine, and (2) maintaining the edge guide in a predetermined angular orientation relative to the machine as the edge guide is swung;

placing the edge of the workpiece against the edge guide so that the workpiece is in the predetermined angular orientation relative to the machine; and swinging the edge guide to adjust its distance from the machine so that the workpiece will be in a desired position relative to the machine when the workpiece's edge is placed against the edge guide.

20. A method as claimed in claim 19, wherein the predetermined angular orientation is parallel to the machine.

* * * * *